United States Patent [19]

Achinger et al.

[11] Patent Number: 4,537,238

[45] Date of Patent: Aug. 27, 1985

[54] MOLDING MACHINE FOR MAKING FLASKLESS MOLDS

[75] Inventors: Michael Achinger, Neuburger Strasse 40, 8900 Augsburg, Fed. Rep. of Germany; Erhard Jaeger, Mettmann; Reinhold Lipp, Holzheim; Walter Streitenberger, Freidberg-Derching, all of Fed. Rep. of Germany

[73] Assignee: Michael Achinger, Augsburg, Fed. Rep. of Germany

[21] Appl. No.: 468,624

[22] Filed: Feb. 22, 1983

[30] Foreign Application Priority Data

Feb. 20, 1982 [DE] Fed. Rep. of Germany ..... 3206169

[51] Int. Cl.[3] ..... B22C 15/00

[52] U.S. Cl. ..... 164/169; 164/200

[58] Field of Search ..... 164/160.1, 169, 200, 164/201, 202, 27, 29, 7.1, 15, 159

[56] References Cited

U.S. PATENT DOCUMENTS

| | | | |
|---|---|---|---|
| 3,096,547 | 7/1963 | Hunter et al. | 164/200 X |
| 3,528,481 | 9/1970 | Lund | 164/200 X |
| 3,556,196 | 1/1971 | Bühler | 164/187 X |
| 4,182,395 | 1/1980 | Bühler | 164/195 X |
| 4,262,731 | 4/1981 | Wetzel | 164/201 X |
| 4,313,486 | 2/1982 | Kondo et al. | 164/200 X |

FOREIGN PATENT DOCUMENTS

| | | | |
|---|---|---|---|
| 33290 | 10/1978 | Japan | 164/200 |
| 139255 | 10/1981 | Japan | 164/200 |

*Primary Examiner*—Nicholas P. Godici
*Assistant Examiner*—G. M. Reid
*Attorney, Agent, or Firm*—Edwin E. Greigg

[57] ABSTRACT

The invention discloses a molding machine for making flaskless molds, which has a minimum of structural component groups and units as well as of control devices and adjusting elements. The machine frame is embodied by a closed, symmetrical frame including hollow side parts which receive the pourable molding material and simultaneously perform the functions of tie rods and guidance for the molding flasks. Molding sand blowing-in openings are disposed on the inner walls of the side parts, and the openings are controlled by molding sand openings in the molding flasks in the manner of a valve slide.

12 Claims, 4 Drawing Figures

MOLDING MACHINE FOR MAKING FLASKLESS MOLDS

BACKGROUND OF THE INVENTION

The invention relates to a molding machine for making flaskless molds. The molding machine has two molding flasks, which are movable back and forth on a model plate carrier which in turn is movable in and out between the two molding flasks, and a hollow machine frame which receives the pourable molding material. The molding flasks are enclosed by a rectangular frame which absorbs the reactive forces occurring during the pressure-shaping process.

From U.S. Pat. No. 3,556,196, which is based on German Pat. Nos. 15 83 526 and 17 58 245, a molding machine for making flaskless molds is known, in which two molding flasks which are movable back and forth and a match plate carrier movable in and out between them are enclosed by a rectangular frame, the vertical columns of which absorb the reactive forces initiated during the compression of the molding material. However, these columns are massive in embodiment and have an exclusively static function.

From the same U.S. patent, a molding machine is also known has a hollow machine frame embodied in the shape of a C in the central vertical plane. The vertical bar is embodied as a connecting line for molding sand, and the bottom and top arms of the C serve to introduce the molding sand into the mold cavities of the two molding flasks in the closed position thereof. The two ends of the C arms facing one another are each enclosed by one annular cylinder, in each of which an annular piston subjected to a pressure medium reciprocates. The annular piston is connected in turn with a grate-like press die. These bar grates are subject to erosion by the molding sand flowing through them and accordingly experience heavy wear. In addition, two adjusting cylinders each are required for moving the two molding flasks. Since a machine frame in the form of an open C would break apart under the high pressures exerted, tie rods are furthermore required, as explained and illustrated at the beginning of the above-mentioned U.S. patent.

From German laid-open applications DE-OS Nos. 30 21 592 and 28 14 140, it is known to blow the molding sand into the mold cavities from containers for molding sand disposed laterally adjacent the molding flask or flasks.

OBJECT AND SUMMARY OF THE INVENTION

It is accordingly an object of the present invention to create a molding machine for making flaskless casting molds with the least possible number of structural component groups and units, which nevertheless assures the same quality as expensive machines in terms of precision, and especially in terms of the quality of molding material used, which is a standard determinant for finished output. In mechanical engineering it is a long-familiar fact that a machine is all the more vulnerable to breaking down, the more complicated its structure, because every machine is only as strong as its weakest part. By reducing the number of structural components it is thus intended that the vulnerability to breakdown should be reduced to a minimum. As a whole, the costs for manufacturing and operating these molding machines should be reduced thereby to such an extent that even small and middle-sized companies without great financial resources will be able to use such machines.

This object is attained in accordance with the present invention primarily in that the rectangular frame embodying the machine frame is symmetrical in the central plane that is normal to the vertical central plane of the machine frame; that the side parts forming the longitudinal struts are at the same time hollow for receiving the pourable molding material and are connected in a contiguous manner with a funnel for pouring the molding sand into each of the hollow struts. In the vicinity of the closed position of the molding flasks or in other words when the flasks are resting on the match plates, these side parts have openings for blowing sand into the molding flasks; and the side parts furthermore include guides for the axial displacement of the molding flasks.

The machine frame itself, embodied in accordance with the invention, thus assumes three roles at once: making available the molding material which is to be blown in; performing tie rod functions; and performing guidance functions for the molding flasks.

From the basic concept according to the invention, further advantageous characteristics of the embodiment can be derived for the sake of reducing the costs of manufacture and operation. These will now be explained in terms of one exemplary embodiment, taken in conjunction with the drawings.

DESCRIPTION OF THE PREFERRED EMBODIMENT

Figure 3:
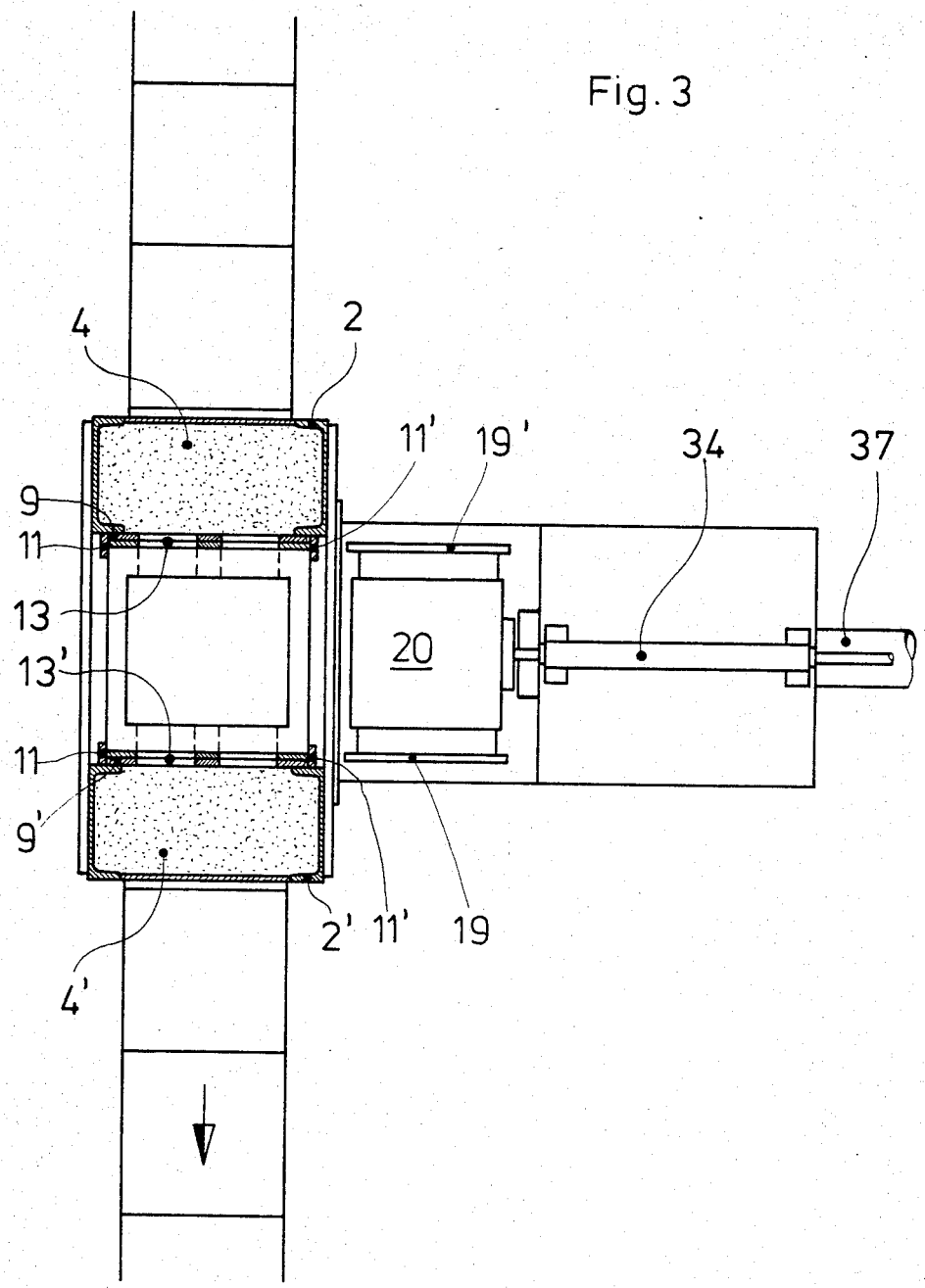
FIG. 3 shows the same machine in a horizontal section taken along the line III—III of FIG. 2.

In the drawings, reference numeral 1 refers to the machine frame, embodied as a closed, symmetrical frame, the side parts 2, 2', which form the side struts, connected with the upper crosspiece 3 and the lower crosspiece 3'. The side parts 2, 2', as may be seen from FIG. 3, are embodied as sturdy, profiled, sheet-metal flask elements, so that they are reliably capable of absorbing the reactive forces initiated in them during the pressure-shaping process. The cavities 4, 4' serve to receive the pourable molding material (indicated by dots) and they extend at least over the vertical displacement path "s" of the molding flasks 5, 6.

On the upper end of the frame, the side parts 2, 2' are connected in a contiguous manner with the funnel 7 for pouring molding sand into the side parts 2, 2'. The guide plates 8, 8' and 9, 9' for the molding flasks 5, 6 are attached to the inner sides of the side parts 2, 2' facing one another, and the molding flasks 5, 6 in turn grip the guide plates on the edges having the guide panels 10, 10' and 11, 11' (see also FIG. 3).

Upper openings 12, 12' and the lower openings 13, 13', which are embodied as slots, are machined into the two side parts 2, 2', and openings 14, 14' and 15, 15', which are likewise slot-like in embodiment, are disposed opposite one another in opposite sides of the molding flasks 5, 6 for blowing molding sand into the molding flasks 5 and 6. When the molding flasks 5, 6 are moved apart the openings 12, 12' and 13, 13' in the side parts 2, 2' are closed and prevent the molding sand from entering the molding flasks. When the molding flasks 5, 6 have been moved into a mold forming position and are resting on the match plates 16, 17, the openings 12, 12' and 13, 13' are aligned with and communicate in a fully open manner with the openings 14, 14' and 15, 15', respectively, in the molding flasks. The alignment permits sand to be blown into the molding flask so that the cavity is filled with sand. The sand in the filled cavity is then pressed under the force of the pistons 25 and 27 to form the mold halves 31 and 32. Thus the molding flasks at the same time assume the function of valve slides controlling the molding sand blow-in slots in the side parts 2, 2', so that special valves for this purpose are not necessary. The disposition of the sand blow-in openings opposite one another thus reliably prevents the formation of "lee" or windless zones, such as are frequently found when molding material is blown in from only one side.

The guide plates 8, 8' and 9, 9' forming the guide tracks are disposed at a spacing "a" from one another, so that one guide slot 18, 18' each is formed on each side part, while the flask-like match plate carrier 20, which is equipped with crosshead-like guide sleds 19, 19' (see FIG. 3), is guided in these guide slots 18, 18' as it is driven inward between the molding flasks 5 and 6. At the same time, the slots 18, 18' serve to fix the match plates 16, 17 in position during the pressure-shaping process.

Figure 1:
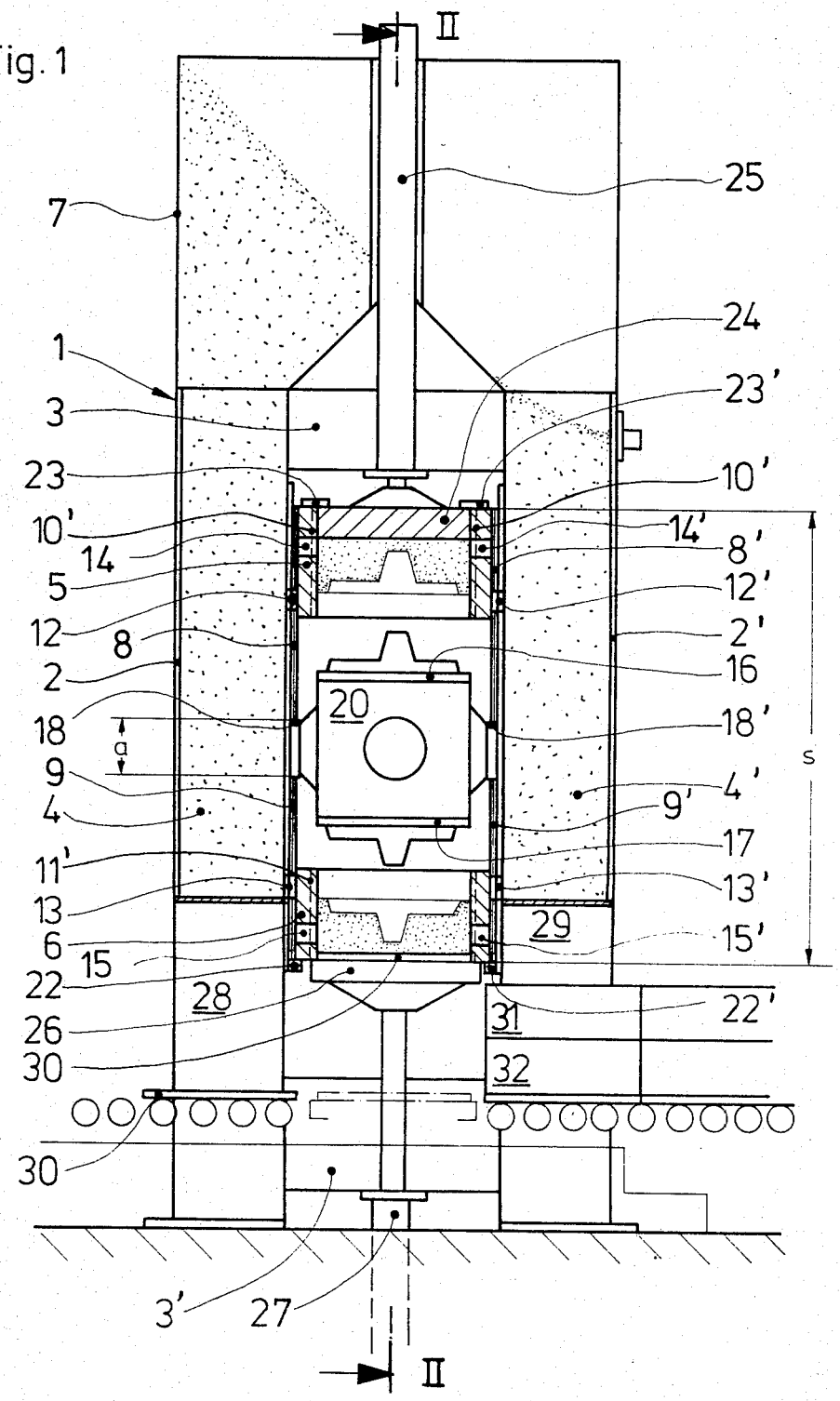
FIG. 1 shows a molding machine with pressure forces exerted in the vertical direction, seen in a vertical section taken along the line I—I of FIG. 2.
Figure 2:
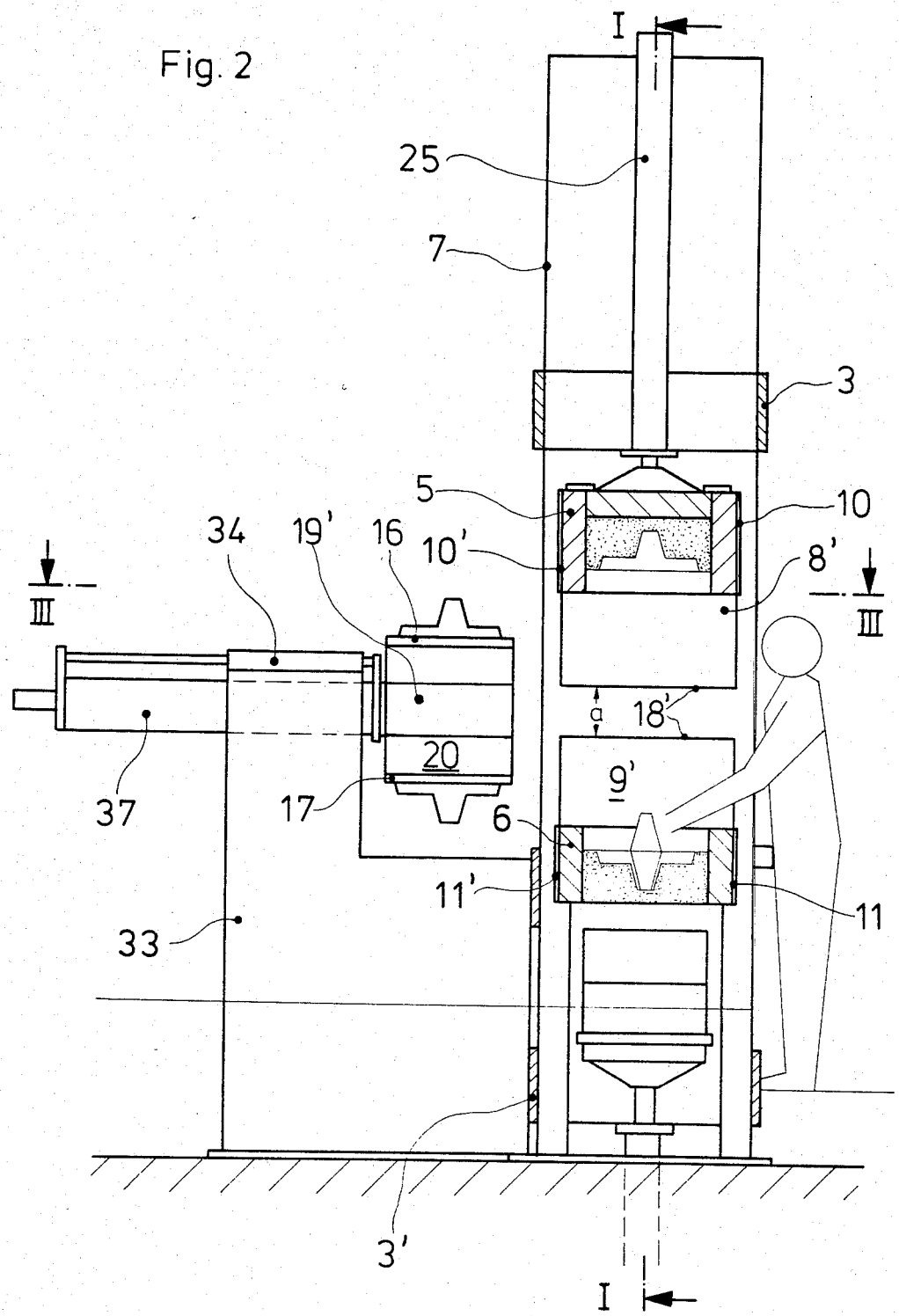
FIG. 2 is a vertical section of the same machine taken along the line II—II of FIG. 1.

The molding flask 6 as seen in FIG. 1 is located in the mold removal position and is resting on the stops 22, 22', while in contrast the upper molding flask 5 disposed opposite to molding flask 6 has driver panels 23, 23' with which the molding flask 5 is suspended on the press die 24 of the press cylinder 25 associated with it. The lower molding flask 6, contrarily, when it is moved upward is carried along by the press die 26 of the press cylinder 27. It is thus possible to dispense with complicated lever arrangements and their associated control means, which tend to break down under the rough operating conditions prevailing in a molding plant.

At the lower end, the rectangular frame has openings 28, 29 for the introduction of pallets 30 or for the removal of the finished, assembled packet formed by mold halves 31, 32.

After the molding sand has been compressed in the mold cavities with the aid of the press dies 24 and 26, the molding flasks 5, 6 are moved apart and the match plate carrier 20 is removed from between them. In a known manner, the two mold halves 31, 32 are then stripped, placed on the press die 26 together with the pallet 30 that moves with them, and lowered to the level of the roll table.

Figure 4:
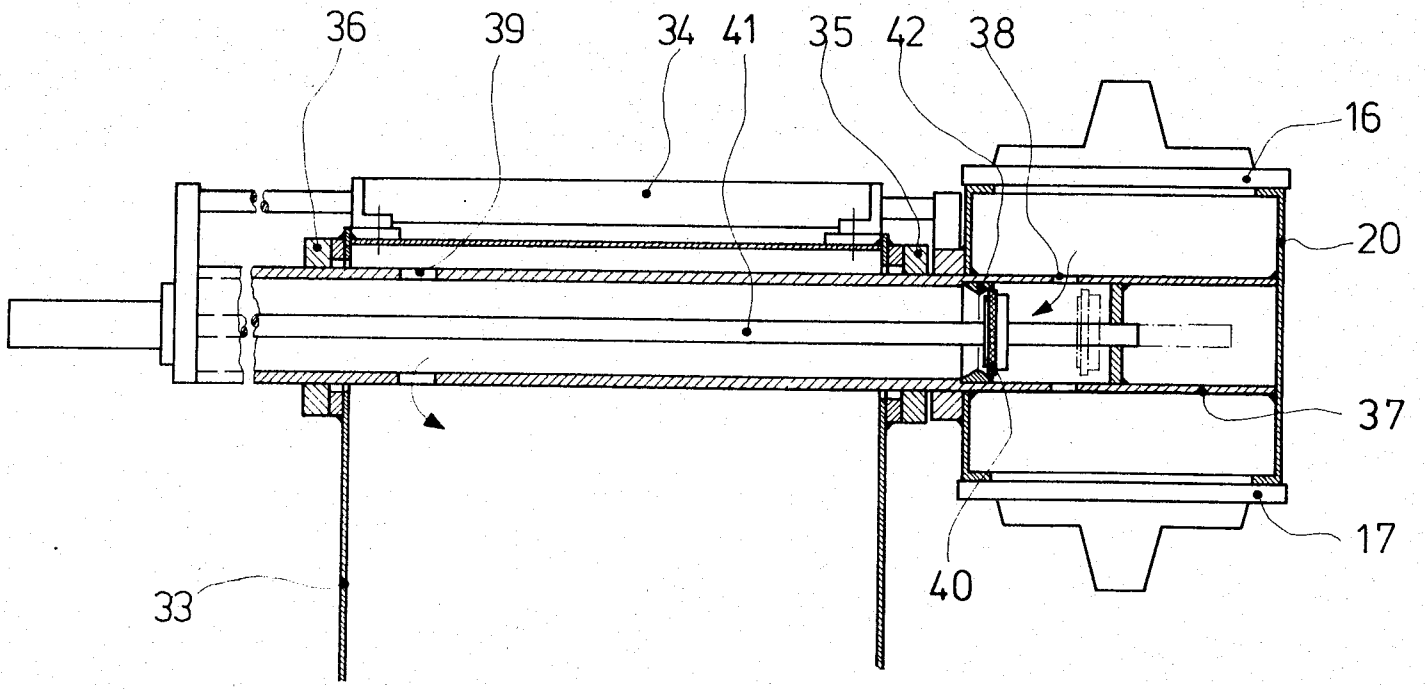
FIG. 4 is a vertical section taken through the match plate carrier apparatus, shown on an enlarged scale.

The match plate carrier 20, as shown in FIG. 4, is embodied as a hollow, hermetically sealed flask. It is secured on the end of a supporting tube 37 which passes through the vacuum container 33 and is supported rotatably in the bearings 35, 36 such that it is axially displaceable with the adjusting cylinder 34. The supporting tube 37 has flowthrough openings 38, 39 both toward the flask and in the inflow zone of the vacuum container 33. A plate valve 40 having the valve seat 42 is furthermore accommodated in the supporting tube 37, being controlled with the valve rod 41 that passes through the supporting tube 37. The blown air sucked out of the mold cavities therefore flows through openings 38 in the match plates 16, 17 indicated in FIG. 4 and into the hollow flask of the match plate carrier 20, and when the valve 40 is opened this air flows through the openings 38, into the supporting tube 37 and through the openings 39 into the vacuum container 33. The term "vacuum" here should be understood to mean any pressure that is lower than the pressure of the blown-in air.

What is claimed and desired to be secured by Letters Patent of the United States is:

1. A molding machine for pressure shaping flaskless molds comprising a rectangular support frame including a pair of oppositely disposed side parts, two oppositely disposed molding flasks which are movable back and forth vertically and enclosed within said pair of side parts, a match plate carrier that can be moved in a horizontal direction into and from a position between said molding flasks, said match plate carrier including oppositely disposed match plates thereon, said rectangular support frame in which said molding flasks are enclosed absorbs any reactive forces arising during a pressure-shaping process, said side parts are hollow for receiving a pourable molding material, said rectangular frame being symmetrical in a central plane that is normal to a vertical central plane of the rectangular frame, said side parts containing oppositely disposed openings and each of said molding flasks having oppositely disposed openings in their sides which are in alignment with said openings in said side parts when said molding flasks are in a mold forming position relative to said match plates so that molding material can be transferred from said side parts to said molding flasks via said openings, and guide plates on said side parts for guiding said molding flasks for movement relative to said side parts.

2. A molding machine as defined by claim 1, characterized in that said side parts are embodied in said rectangular support frame, at least over the displacement path of the molding flasks and are rectangular, hollow profiled elements formed of sheet metal which are connected on their ends by crosspieces.

3. A molding machine as defined by claim 1, characterized in that said openings in both side parts and in both molding flasks are related in such a manner that when the molding flasks are moved apart the openings in the side parts are closed by said molding flasks, and when the molding flasks are resting on the match plates, the openings in the side parts are in flowthrough communication with the openings in the molding flasks.

4. A molding machine as defined by claim 2, characterized in that said openings in both side parts and in both molding flasks are related in such a manner that when the molding flasks are moved apart the openings in the side parts are closed by said molding flasks, and when the molding flasks are resting on the match plates, the openings in the side parts are in flowthrough communication with the openings in the molding flasks.

5. A molding machine as defined by claim 1, characterized in that a pair of guide plates are secured to each of the side parts and are spaced apart from one another by a distance "a", such that one guide slot is formed between said pair of guide plates on each side part for guiding guide sleds equipped on the match plate carrier.

6. A molding machine as defined by claim 2, characterized in that a pair of guide plates are secured to each of the side parts and are spaced apart vertically from one another by a distance "a", such that one guide slot is formed between said pair of guide plates on each side part for guiding sleds equipped on the match plate carrier.

7. A molding machine as defined by claim 3, characterized in that a pair of guide plates are secured to each of the side parts and are spaced apart vertically from one another by a distance "a", such that one guide slot is formed between said pair of guide plates on each side part for guiding sleds equipped on the match plate carrier.

8. A molding machine as defined by claim 1, characterized in that one molding flask when located in a mold removal position rests on a stop, while in contrast one molding flask in opposition thereto has driver panels by which one said molding flask is suspended on a press die of a press cylinder associated with said one molding flask.

9. A molding machine as defined by claim 2, characterized in that one molding flask when located in a mold removal position rests on a stop, while in contrast one molding flask in opposition thereto has driver panels by which one said molding flask is suspended on a press die of a press cylinder associated with said one molding flask.

10. A molding machine as defined by claim 3, characterized in that one molding flask when located in a mold removal position rests on a stop, while in contrast one molding flask in opposition thereto has driver panels by which one said molding flask is suspended on a press die of a press cylinder associated with said one molding flask.

11. A molding machine as defined by claim 4, characterized in that one molding flask when located in a mold removal position rests on a stop, while in contrast one molding flask in opposition thereto has driver panels by which one said molding flask is suspended on a press die of a press cylinder associated with said one molding flask.

12. A molding machine for pressure shaping flaskless molds comprising a rectangular support frame including a pair of oppositely disposed side parts, two oppositely disposed molding flasks which are movable back and forth vertically and enclosed within said pair of side parts, a match plate carrier that can be moved in a horizontal direction into and from a position between said molding flasks, said match plate carrier is embodied as a hollow flask and includes oppositely disposed match plates thereon, said match plate carrier is secured on an end of a supporting tube which passes through a vacuum container and is supported in an axially displaceable and rotatable manner, said rectangular support frame in which said molding flasks are enclosed absorbs any reactive forces arising during a pressure-shaping process, said side parts are hollow for receiving a pourable molding material, said rectangular frame being symmetrical in a central plane that is normal to a vertical central plane of the rectangular support frame, said side parts containing oppositely disposed openings and each of said molding flasks having oppositely disposed openings in their sides which are in alignment with said openings in said side parts when said molding flasks are in a mold forming position relative to said match plates so that molding material can be transferred from said side parts to said molding flasks via said openings, and guide plates on said side parts for guiding said molding flasks for movement relative to said side parts, said supporting tube including flowthrough openings through which air used to blow sand into a mold formed by said molding flasks and said match carrier plate is directed, a valve plate disposed inside said supporting tube for controlling air flow through said flow through openings in said supporting tube, said valve plate being controllable with a valve rod passing through said supporting tube, and said rectangular frame includes openings at one end for introduction of pallets and for removal of formed, finished mold halves.

* * * * *